US008876219B2

(12) United States Patent
Hausladen et al.

(10) Patent No.: US 8,876,219 B2
(45) Date of Patent: Nov. 4, 2014

(54) SELF-PROPELLED SURFACE MILLING CUTTER

(75) Inventors: Norbert Hausladen, Biberach an der Riss (DE); Viktor Schindler, Uttenweiler (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 13 days.

(21) Appl. No.: 13/552,471

(22) Filed: Jul. 18, 2012

(65) Prior Publication Data

US 2013/0038114 A1 Feb. 14, 2013

(30) Foreign Application Priority Data

Jul. 19, 2011 (DE) ..... 10 2011 108 016

(51) Int. Cl.

| | |
|---|---|
| ***E01C 23/088*** | (2006.01) |
| ***E21C 47/00*** | (2006.01) |
| ***E01H 5/09*** | (2006.01) |
| ***E21C 31/00*** | (2006.01) |
| *E21C 27/24* | (2006.01) |

(52) U.S. Cl.

CPC ..... *E01H 5/098* (2013.01); *E01C 23/088* (2013.01); *E21C 47/00* (2013.01); *E21C 31/00* (2013.01); *E21C 27/24* (2013.01)

USPC ..... 299/39.4

(58) Field of Classification Search

CPC ..... E01C 23/088; E21C 25/08

USPC ..... 299/39.1, 39.4, 39.5, 39.7

See application file for complete search history.

(56) References Cited

U.S. PATENT DOCUMENTS

| | | | | |
|---|---|---|---|---|
| 3,895,843 | A * | 7/1975 | Wall et al. | 299/39.6 |
| 4,047,763 | A * | 9/1977 | Gilliland et al. | 299/76 |
| 4,172,616 | A * | 10/1979 | Delli-Gatti, Jr. | 299/80.1 |
| 4,210,291 | A * | 7/1980 | Kienast | 241/110 |
| 6,158,818 | A * | 12/2000 | Schaeff et al. | 299/78 |
| 7,883,153 | B2 * | 2/2011 | Stiffler et al. | 299/80.1 |

FOREIGN PATENT DOCUMENTS

| | | | |
|---|---|---|---|
| CA | 2736867 | A1 | 10/2011 |
| DE | 19941800 | A1 | 5/2000 |
| DE | 19941799 | A1 | 6/2000 |
| DE | 202007002403 | U1 | 5/2007 |
| DE | 102007007996 | B4 | 10/2008 |
| DE | 102007044090 | A1 | 4/2009 |
| DE | 102007028812 | B4 | 8/2009 |
| DE | 102008008260 | A1 | 8/2009 |
| DE | 102010023024 | A1 | 10/2011 |
| WO | 03058031 | A1 | 7/2003 |

* cited by examiner

*Primary Examiner* — David Bagnell
*Assistant Examiner* — Michael Goodwin
(74) *Attorney, Agent, or Firm* — Alleman Hall McCoy Russell & Tuttle LLP

(57) ABSTRACT

The present disclosure relates to a self-propelled surface milling cutter, with a working assembly comprising a rotatingly drivable drum body, and at least one drum drive unit which is accommodated in the interior of the drum body and forms at least part of a rotatable bearing of the drum body on a drum supporting frame, wherein the at least one drum drive unit includes a stationary drive part attached to the drum supporting frame and a rotatable drive part connected with the drum body. The rotatable drive part of the drum drive unit is mounted on the drum body by a positive entrainment connection in a torque-transmitting, but longitudinally movable manner. The entrainment connection rotatorily entrains the drum body, in order to be able to transmit the rotary drive movements of the drive part to the drum body.

24 Claims, 3 Drawing Sheets

SELF-PROPELLED SURFACE MILLING CUTTER

CROSS REFERENCE TO RELATED APPLICATION

This application claims priority to German Patent Application No. 10 2011 108 016.7, entitled "Self-Propelled Surface Milling Cutter," filed Jul. 19, 2011, which is hereby incorporated in its entirety for all purposes.

TECHNICAL FIELD

The present disclosure relates to a self-propelled surface milling cutter, for example in the form of an asphalt milling cutter, a snow blower or a surface miner, with a working assembly comprising a rotatingly drivable drum body, and at least one drum drive unit which is accommodated in the interior of the drum body and forms at least part of a rotatable bearing of the drum body on a drum supporting frame, wherein the at least one drum drive unit includes a stationary drive part attached to the drum supporting frame and a rotatable drive part connected with the drum body.

BACKGROUND AND SUMMARY

Surface milling cutters, for example in the form of surface miners, are continuously operating open-pit mining machines by which a rotating drum millingly comminute the rock or the ground and usually continuously move ahead by via a track-laying gear, in order to drive the drum into the rock. Said drum forms the main working assembly which requires a high performance and insofar a suitable drive. In this respect, DE 10 2007 007 996 B4 proposes a diesel-electric drive in which the milling drum of the surface miner is driven by means of an electric motor, which is supplied with electricity by a generator which in turn is driven by a diesel unit. Further configurations of surface miners are also disclosed in the documents WO 03/058031 A1, DE 10 2008 008 260 A1, DE 10 2007 044 090 A1, DE 10 2007 028 812 B4, DE 199 41 800 C2, DE 199 41 799 C2 or DE 20 2007 002 403 U1, wherein instead of the electromotive drives hydraulic drives also are used in part, which are fed with hydraulic energy by a hydraulic pump driven by the diesel engine.

A surface miner with an internal electric motor drive for the milling drum is known from DE 10 2007 007 996 B4. Two controllable squirrel-cage motors, each with an associated planetary transmission, are accommodated in the interior of the milling drum body, so that the milling drum drives are properly protected against external influences and damage, e.g. by stones. To protect each of the transmission and the electric motor against dust, the opposed end faces of the motor-transmission unit seated in a tubular frame piece are closed with pot-shaped housing parts which with one ring seal each are connected to the supporting frame in a dust-tight manner. The housing of the motor-transmission unit at the same time serves for supporting the drum body on said supporting frame. A stationary housing part surrounding the electric motor is rigidly connected with a supporting frame part, which on the end face reaches into the drum body. A rotating housing part connected with the drum body, which encloses the transmission, is rotatably mounted on said stationary housing part by an anti-friction bearing and sealed by a ring seal.

In such motor-transmission units which support the milling drum and are used for rotatably supporting said milling drum, the sealing of the housing is critical. Expediently, the rotating housing part is sealed against the stationary housing part not only in a dust-tight manner, but also in an oil-tight manner, so that the transmission can run in an oil bath. Corresponding seals such as sliding ring seals are sensitive to axial and radial offsets as well as angular offsets, which can easily occur due to the high forces introduced between the two housing parts, when this is not prevented by the bearing in the vicinity of the seal.

A neat sealing of said housing parts, however, not only is necessary to avoid oil leakage, but also due to the often dusty operating conditions. A dust input into the interior of the housing and hence into the transmission and the electric motor would drastically shorten the useful life of the motor-transmission unit, so that suitable measures also are required against dust input into the motor.

To avoid constraints and offsets of the seal provided between the rotating drive part and the stationary drive part and overloads of the bearings integrated into the drum drive, it has already been considered to form the drum supporting frame in an axially resilient or compensating way, so that the distance of the two drum supporting frame parts, which each enclose the drum body on the end face, from each other can vary or be adapted to the thermal expansions. However, this necessitates a more or less expensive design of the drum supporting frame. In addition, when shims are used for adjusting the position or the distance of said two drum supporting frame parts, an increased assembly and maintenance effort is involved.

Therefore, it is the object underlying the present disclosure to create an improved surface milling cutter of the type mentioned above, which avoids the disadvantages of the prior art and develops the latter in an advantageous way. In particular, despite a dissipation of the drum bearing forces via the drum drive unit, a leakage-free and dust-tight sealing of the drum drive unit should be achieved without axial constraints of the corresponding seal and without axial overload of the bearings, without paying for this with increased maintenance and assembly hostility.

In accordance with the present disclosure, this object is solved by a surface milling cutter that provides an axial degree of freedom between a drum drive unit and a drum body despite the dissipation of drum bearing forces via the drive unit and despite the transmission of torque from the drum drive unit to the drum body, in order to avoid axial constraints and compensate an axial offset in direction of the longitudinal axis and rotational axis of the drum, for example as a result of thermal expansion and component tolerances. In an axial direction, the drum drive unit no longer is rigidly connected with the drum body, but can be moved in a direction of the axis of rotation of the drum body relative to the same optionally also in operation. In accordance with the present disclosure, the rotatable drive part of the drum drive unit is supported on the drum body by a positive entrainment connection in a torque-transmitting, but longitudinally movable manner. The entrainment connection rotatorily entrains the drum body, in order to be able to transmit the rotary drive movements of the drive part to the drum body. However, the rotating drive part can be reciprocated relative to the drum body in the direction of its longitudinal axis, in order to compensate an axial offset, for example as a result of thermal expansions or dimensional tolerances or mounting inaccuracies.

By omitting an axial rigid fixation of the rotating drive part on the drum body, axial forces between the rotating drive part and the stationary drive part of the drum drive unit can be avoided and overloads of the fixed bearings provided for rotatably supporting the drum body can be prevented. Advantageously, a seal between the rotating and stationary drive parts can also be protected against excessive axial forces, which would impair the sealing effect.

In accordance with a development of the present disclosure, the entrainment connection not only can be formed in a torque-transmitting, but also radially supporting, in particular centering manner, in particular such that due to said entrainment connection the drum body is supported on the drum drive unit optionally without clearance transverse to its axis of rotation. Although the entrainment connection permits displacements between the rotatable drive part and the drum body in axial direction, i.e. parallel to the longitudinal axis of the drum body, the drum body nevertheless is supported on the rotatable drive part transverse to the longitudinal axis of the drum body, so that corresponding drum bearing forces are dissipated via the drum drive unit transverse to the longitudinal axis of the drum body. The entrainment connection advantageously can form a non-rotatable sliding guideway which guides the drum drive unit in the drum body, secured against rotation, but longitudinally movable.

For this purpose, the entrainment connection in principle can be formed in different ways. In an advantageous development of the present disclosure, the entrainment connection can comprise two axially spaced, radially effective support bearings, by means of which the drum body is radially supported on the rotating drive part of the drum drive unit and also is propped against tilting with respect to the drum body. Said support bearings advantageously can be formed in the form of centering fitting surfaces, which center and radially support the drive unit or its rotating drive part in the drum body. Advantageously, said support bearings have a great distance from each other relative to the axial length of the rotating drive part, in order to inhibit tiltings in the region of the entrainment connection and avoid excessive surface pressures as a result of tilting moments. In accordance with a development of the present disclosure, the axial distance of said two radially effective support bearings can amount to more than 50% of the axial length of the rotating drive part of the drum drive unit.

The torque-transmitting effect of the entrainment connection in principle can be achieved by various formations of the entrainment connection. An advantageous development of the present disclosure can consist in that the entrainment connection includes a toothing with a first tooth part on the drive part and a second tooth part on the drum body. By such toothing, high torques can also be transmitted from the drive part to the drum body without excessive surface pressures and overloads of the material. Nevertheless, the tooth parts in engagement with each other can axially slide on each other in direction of the longitudinal axis of the drum body, in order to permit the axial compensation.

In principle, the toothing can be formed in different ways, wherein in an advantageous development of the present disclosure a spline with involute flanks can be provided. In this way, high torques can be transmitted with a simple fabrication, wherein the toothing at the same time is formed approximately without clearance. Alternatively, the entrainment connection also can be formed in the manner of a splined shaft/hub profile or a polygonal shaft/hub connection. In one example, the aforementioned spline may be used, which combines an easy manufacturability with high transmittable torques at low surface pressures and at the same time axial shiftability.

The toothing here could also be formed to be radially self-supporting, so that radial drum supporting forces are dissipated directly via said toothing and can be introduced into the rotating drive part of the drum drive unit. Advantageously, said toothing can, however, be protected against radial overloads by an additional radially effective support bearing, wherein advantageously one of the aforementioned radially effective support bearings, for example in the form of a centering fitting surface, advantageously can be provided directly on or beside said toothing.

In accordance with a development of the present disclosure, such radially effective support bearing, for example in the form of a centering surface, can be formed by a bearing flange radially protruding in the interior of the drum body from its wall to the inside, in that a fitting bore coaxial to the drum axis of rotation can be provided, in which the rotatable drive part can accurately be seated with an outer circumferential surface.

To facilitate the assembly, disassembly and maintenance of the drum drive, the entrainment connection in accordance with a development of the present disclosure is formed such that the drum drive unit can axially be withdrawn from the drum body as a whole without demounting individual drive parts, whereby the entrainment connection is released. In particular, the positively acting entrainment connection can be formed without undercut in axial direction towards a drum body end face, so that the parts of the entrainment connection provided on the drive part pass by along the parts of the entrainment connection provided on the drum body, without colliding with each other, so that the drum drive can be withdrawn from the drum body. In particular, the radial support bearings of the entrainment connection can increase in diameter towards the drum body end face. If the entrainment toothing in accordance with an advantageous development of the present disclosure for example is arranged deeper in the drum body and a radially effective supporting surface is arranged less deep in the drum body, i.e. closer to its end face, said radially effective supporting surface can be dimensioned sufficiently large in its diameter, in order to be able to move the drive-part-side toothing part therethrough without collision.

To prevent fretting rust on said entrainment connection, a lubricant reservoir for lubricating said entrainment connection and for protecting the entrainment connection against fretting rust can be provided in the interior of the drum body in accordance with an advantageous embodiment of the present disclosure. From said lubricant reservoir, lubricant can get onto the fitting surfaces of the entrainment connection between drive housing part and drum body, so that there the formation of fretting rust can be prevented or at least be reduced to a minimum.

Advantageously, said lubricant reservoir can form a lubricant bath whose level at least lies above a lower portion of the entrainment connection, so that upon rotation of the drum body the entrainment connection continuously is running through the lubricating bath with its entire circumference.

Advantageously, the lubricant bath is formed such or in terms of its level dimensioned such that at least part of the drive housing part is also wetted. In this way, not only said entrainment connection can be protected against fretting rust, but at the same time the surface of the drum drive unit, in particular of the transmission, can be cooled. Since lubricants such as oil have a high thermal capacity, the cooling effect for the drive housing part and the drive part enclosed by the same is relatively high, all the more so as the heat introduced into the lubricant can be dissipated effectively via the drum body, which has a very large surface to the outside. In this way, a possibly necessary drive or transmission cooling advantageously can be designed to be smaller or less powerful or perhaps be omitted completely.

To improve the lubricant wetting of the drive housing part and thereby improve the dissipation of heat, circulating elements for example in the form of web plates can be provided in the interior of the drum body in accordance with a development of the present disclosure, which again and again thoroughly mix the lubricant due to the rotation of the drum body and carry the lubricant to the top upon rotation of the drum. Alternatively or in addition to such web plates, however, other circulating elements, for example in the form of helical grooves in the inner wall of the drum body and/or the outer wall of the drive part, and/or drag shovels, which, for example, can be mounted at the end-face end of the rotating drive part, can be provided, in order to again and again thoroughly mix the lubricant due to the rotation of the drum body or the drive part and carry the lubricant to the top upon rotation of the drum.

Advantageously, the entrainment connection and/or the interior space of the drum body can be sealed in a lubricant-tight, optionally fluid-tight manner against the rotating drive housing part and/or towards the outside by a sealing device, wherein said sealing device can be integrated into the entrainment connection and for example be formed in the form of an O-ring.

If the entrainment connection as mentioned above comprises a plurality of axially spaced, radially effective supporting points, the sealing device advantageously can be integrated into the outermost supporting point, i.e. the one arranged closest to the drum body end face. Alternatively or in addition, supporting points and/or toothing parts and/or carrier parts of the entrainment connection located further to the inside, i.e. closer to the center of the drum body, can be provided with at least one bypass channel or a passage recess, so that the oil bath or the lubricant substantially can reach all supporting points of the entrainment connection.

Due to the axial shiftability of the torque-transmitting entrainment connection between the rotating drive part and drum body, the drum drive unit can easily be sealed in a dust-tight and/or fluid-tight manner, without a corresponding sealing device being impaired in its sealing effect by axial constraints or overloads. The drum supporting frame, which extends around the end face of the drum body to the right and to the left, can be formed rigid and/or stiff and/or immobile.

The sealing device between the drive housing parts movable relative to each other can be formed differently in principle. According to an advantageous embodiment of the present disclosure, the sealing device can comprise at least one sliding ring seal. Advantageously, a plurality of sliding ring seals can also be provided. Such sliding ring seals are more sensitive with regard to an axial and/or radial and/or angular offset of the components on which they are mounted, but on the other hand, in particular under the influence of dust, they achieve a very much better sealing effect than for example simple radial shaft sealing rings. Said higher sensitivity, however, is taken into account by the non-tiltable as well as axially and radially firm fixed/loose bearing of the drive housing parts relative to each other, so that this property of the sliding ring seals can be accepted, without any disadvantages resulting therefrom.

In a development of the present disclosure, the sealing device also can comprise at least one simple O-ring for oil sealing.

An increased tightness in particular is advantageous when the drive unit includes at least one electric motor, which can be connected with a transmission, in particular an oil-filled transmission, via which the drive movement of the electric motor shaft is transmitted to the drum body with a corresponding step-up/step-down ratio. In so far, the above-described bearing and sealing concept is particularly advantageous for electromotively driven milling drums.

Advantageously, a sealing device can be arranged above the outer circumference of the motor housing of the electric motor. Alternatively or in addition, the sealing device can be arranged between the electric motor and the transmission between said drive housing parts as seen in the axial direction of the drum drive, in particular, for example, in the region of the transmission inlet.

To protect said sealing device against axial and/or radial offset between stationary drive part and rotating drive part, the stationary drive part can firmly be supported radially and/or axially against the rotating drive part, wherein advantageously both an axially and radially firm support is provided. Said support of stationary drive part and rotating drive part relative to each other advantageously at the same time can form the rotatable bearing, via which the drum body is supported on the drum supporting frame. Advantageously, the bearing arrangement for rotatably supporting the drum body on the drum supporting frame thus is integrated into the at least one drum drive unit, wherein advantageously said bearing arrangement integrated into the drum drive unit is formed statically determinate or statically overdeterminate, e.g. formed both axially firm and radially firm. Statically overdeterminate means that there are more physical constraints than degrees of freedom.

To prevent in particular said sealing device between the drive parts rotatable relative to each other from experiencing any axial, radial and/or angular displacements, which would lead to leakages and endanger the dust tightness, the stationary and rotating drive parts not only are supported on each other in an articulated manner by one bearing each, but are supported on each other and fixed axially to each other by a plurality of bearing points with a large supporting distance and hence in a flexurally rigid manner.

In accordance with a development of the present disclosure, the anti-friction bearing arrangement at the drive unit advantageously comprises a bearing point directly below or directly beside the sealing device as well as a bearing point distinctly spaced from the sealing device, so that on the whole a large supporting distance is achieved and the bearing as a whole is flexurally rigid. At the same time, a radial offset at the sealing device is completely inhibited by the arrangement of a bearing point directly at the sealing device. In conjunction with the further bearing point spaced therefrom, an angular offset is prevented at the same time.

Expediently, a bearing point is provided above the motor, for example directly at or as close as possible to the frame strut, whereas a further bearing point is arranged at the transmission inlet. In particular, a bearing point can be arranged at the half of the electric motor housing facing away from the transmission, whereas a further bearing point can be provided in the transition region between the electric motor and transmission. Due to such a spaced arrangement with large bearing distance, small radial forces are transmitted to the bearings from the global bending moments in the entire construction of drum plus frame, which in turn reduce the required moment of resistance of the struts of the frame construction leading upwards to the machine and thus allow an inexpensive frame construction.

In accordance with a development of the present disclosure, at least one of the anti-friction bearing arrangements, which in the aforementioned manner each constitute a radially and axially firm, non-tiltable fixed/loose bearing with at least two spaced bearing points, is integrated into one of the drum drive units or the at least one drum drive unit, wherein said drum drive unit comprises a stationary drive housing part attached to one of the drum supporting frame parts and a rotatable drive housing part connected with the drum body, which on the one hand are sealed against each other by a sealing device and on the other hand are axially, radially and angularly firmly supported relative to each other by said integrated anti-friction bearing arrangement. By integrating the anti-friction bearing arrangement into the drive unit, the bearing and supporting forces of the drum body on the one hand directly are dissipated via the drive unit. On the other hand, separate bearing cylinders, as they were known from the prior art, can be omitted, so that besides a reduction of parts there is also achieved an additional installation space for the drive units.

In accordance with a development of the present disclosure, the stationary drive housing part firmly connected with the drum supporting frame part can be formed by a transmission bell which is put over the motor housing of the electric motor. Said transmission bell thus is pulled over the motor towards the drum supporting frame part. In this case, said transmission bell can form or accommodate the bearing shell also for the bearing arranged above the electric motor.

Alternatively or in addition, the motor housing of the electric motor also can form or accommodate a bearing shell for one of the anti-friction bearings. In this case, said transmission bell can completely be omitted, wherein the motor housing forms a supporting housing part. This leads to a simple and lean solution, because said supporting bell can be omitted. The motor housing of the electric motor thus at least partly forms the stationary drive housing part.

The rotatable drive housing part advantageously is formed by an outer transmission housing part.

In principle, the anti-friction bearing arrangement itself can be formed in different ways. According to an advantageous embodiment of the present disclosure, the anti-friction bearing arrangement of at least one drive unit can comprise a fixed bearing, optionally in the form of a taper or double taper roller bearing in X-arrangement, as well as a radial bearing spaced therefrom. Said double taper roller bearing forms an axial bearing which defines the axial position of the two drive housing parts relative to each other.

Alternatively or in addition, the anti-friction bearing arrangement of at least one or a further drive unit of two spaced taper roller bearings can be provided in an O-arrangement or "<>-arrangement," which can transmit high axial and radial forces at the same time and can compensate tilting moments. When using such taper roller bearing in O-arrangement, the sealing device advantageously is arranged close to or above one of the sets of rolling elements. Alternatively or in addition, however, a taper roller bearing can also be provided in an "X-arrangement." Instead of taper roller bearings, angular-contact ball bearings can also be used, in order to achieve the aforementioned X-arrangement or O-arrangement as well as the corresponding axially firm support, depending on the arrangement of the two angular-contact ball bearings.

Further advantageous formations of the surface milling cutter and its drum drive can be taken from the claims, but also from the following description and the associated Figures of an advantageous embodiment, wherein individual features per se or in combination and sub-combination with each other can be a subject-matter of the present disclosure independent of the grouping of the features in the claims.

The present disclosure will subsequently be explained in detail with reference to an exemplary embodiment and associated drawings.

DETAILED DESCRIPTION

Figure 1:
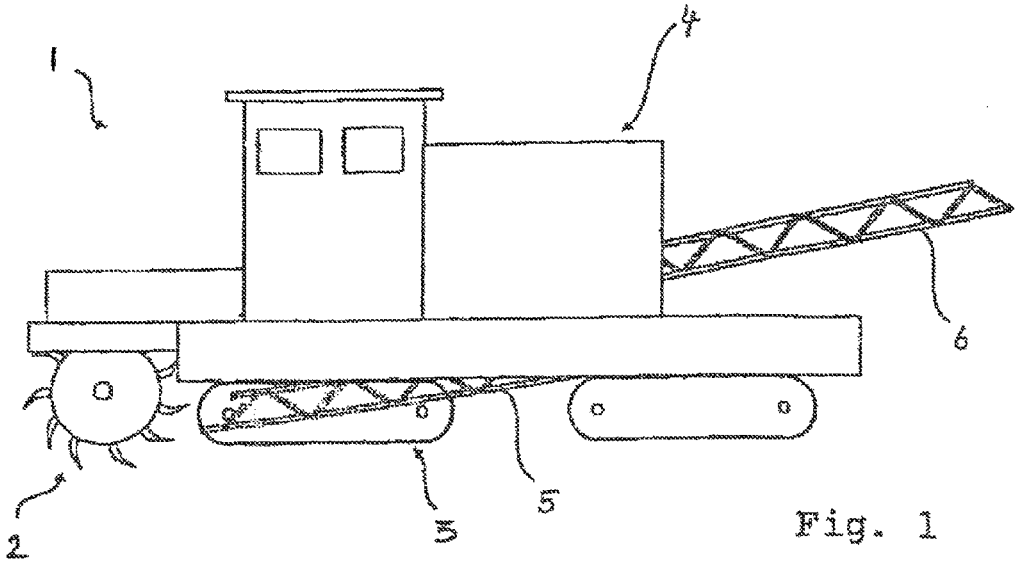
FIG. 1 shows a schematic, perspective representation of a mobile surface milling cutter, which is formed in the form of a surface miner, but can also be formed as an asphalt milling cutter, according to an advantageous embodiment of the present disclosure.

FIG. 1 shows a self-propelled surface milling cutter 1 such as a surface miner or asphalt milling cutter, whose main working assembly forms a milling drum 2 to be rotatably driven about a horizontal axis, on whose circumference cutting tools are mounted, in order to millingly comminute a ground layer or asphalt layer. The surface milling cutter 1 is moved continuously by means of the tracklaying gears 3, so that said milling drum 2 continuously experiences a feed movement. The machine body 4, which is drivably supported on the ground by said tracklaying gears 3 and carries said milling drum 2, furthermore comprises conveying means for removing the milled material. Coming from the milling drum, the milled material is charged onto a receiving conveyor 5, which transfers the material onto a loading conveyor 6, in order to load the comminuted material for example over onto a truck. Said receiving and loading conveyors 5 and 6 can, for example, be formed as belt systems.

Figure 2:
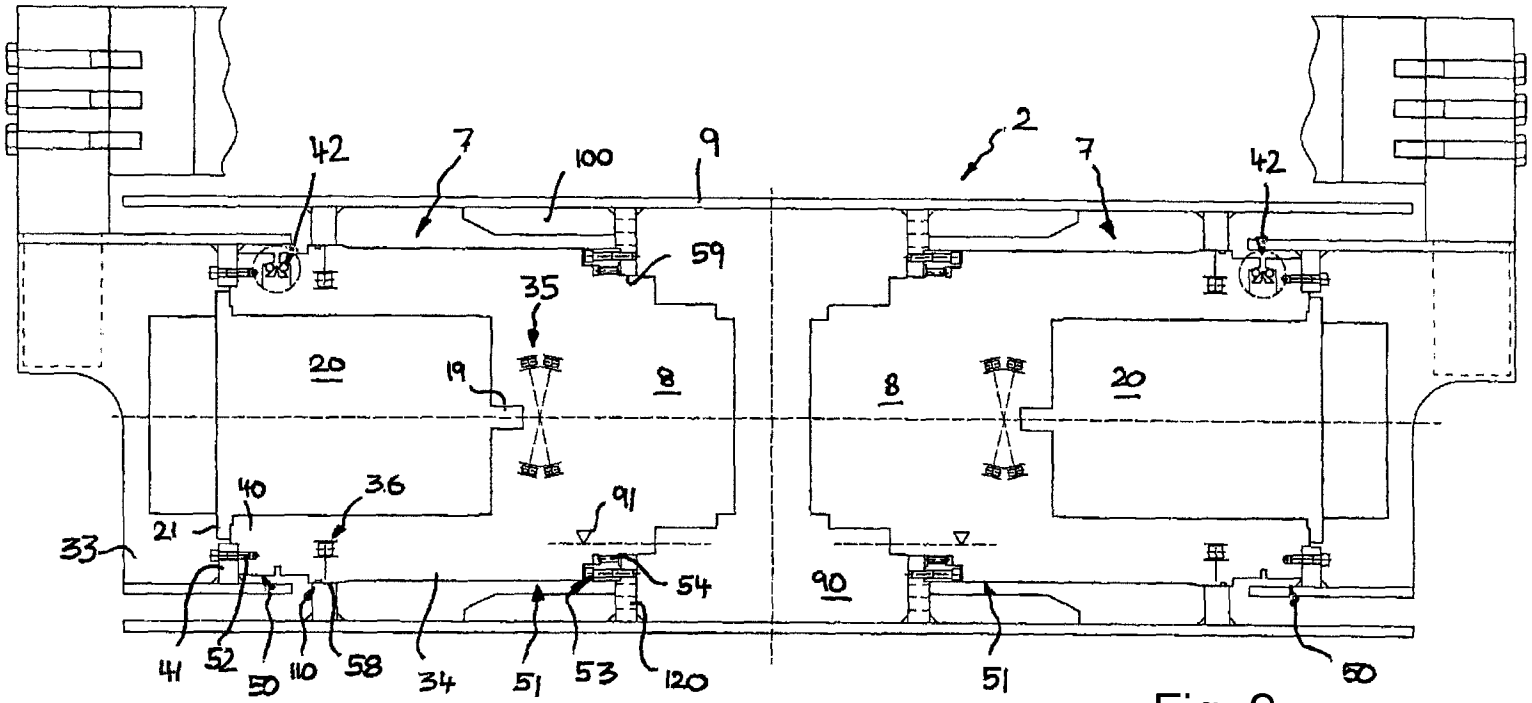
FIG. 2 shows a schematic longitudinal section through the milling drum of the surface milling cutter of FIG. 1, which shows the milling drum drives accommodated in the interior of the milling drum each in the form of an electric motor with a planetary transmission coupled thereto.

According to FIG. 2, the aforementioned milling drum 2 can be driven by means of electric motors 20, which can be connected with the milling drum 2 via a transmission in the form of an epicyclic gear train 8 and can possibly be accommodated in the interior of the milling drum. The milling drum drives 7 each consisting of an electric motor 20 and an epicyclic gear train 8 also serve for supporting the drum body 9. As shown in FIG. 2, the two milling drum drives 7 are arranged to the right and left in the interior of the drum body 9, so that they do rather not protrude beyond the end face of the drum body 9. With its motor housing 21, the electric motor 20 of each milling drum drive 7 is rigidly attached to a supporting frame part 33 via a transmission housing part 40, which on the end face reaches into the drum body 9 and is connected with the machine body 4 of the surface milling cutter 1. Alternatively, the motor housing 21 can form part of the transmission housing. A second transmission housing part 34 on the other hand is rotatably mounted, wherein advantageously a two-point bearing spaced from each other as far as possible is provided, which on the whole is formed in an axially and radially and angularly firm way. In the depicted embodiment of FIG. 2, a conically attached fixed bearing 35, as well as a radial bearing 36 spaced therefrom, is provided.

Said transmission, in the form of an epicyclic gear train 8, advantageously is formed in the form of a planetary transmission, which can be of a multi-stage type, in order to be able to realize a correspondingly large transmission step on a small installation space.

In the embodiment shown in FIG. 2, the epicyclic gear train 8 and the electric motor 20 are arranged coaxial to each other. The motor shaft 19 is connected with the transmission input shaft or forms the transmission input shaft, which at its free end drives a first planetary gear stage via corresponding pinions. Via the planet carriers, further planetary gear stages successively are driven, until the last planetary gear stage finally drives the aforementioned second drive housing part 34, which forms the outer transmission housing part and is non-rotatably and non-tiltably, but longitudinally movably connected with the drum body 9.

Via said anti-friction bearing arrangement, this rotatable housing part 34 is supported on the stationary housing part 40, which is formed by a transmission bell which at the transmission inlet encloses the transmission or motor shaft 19 and is seated above the motor housing 21 with a part expanded in diameter. Together with said motor housing 21 said transmission bell, which forms the fixed housing part 40, is rigidly attached to a mounting flange 41 which is part of the drum supporting frame part 33 or is rigidly connected therewith.

Figure 3:
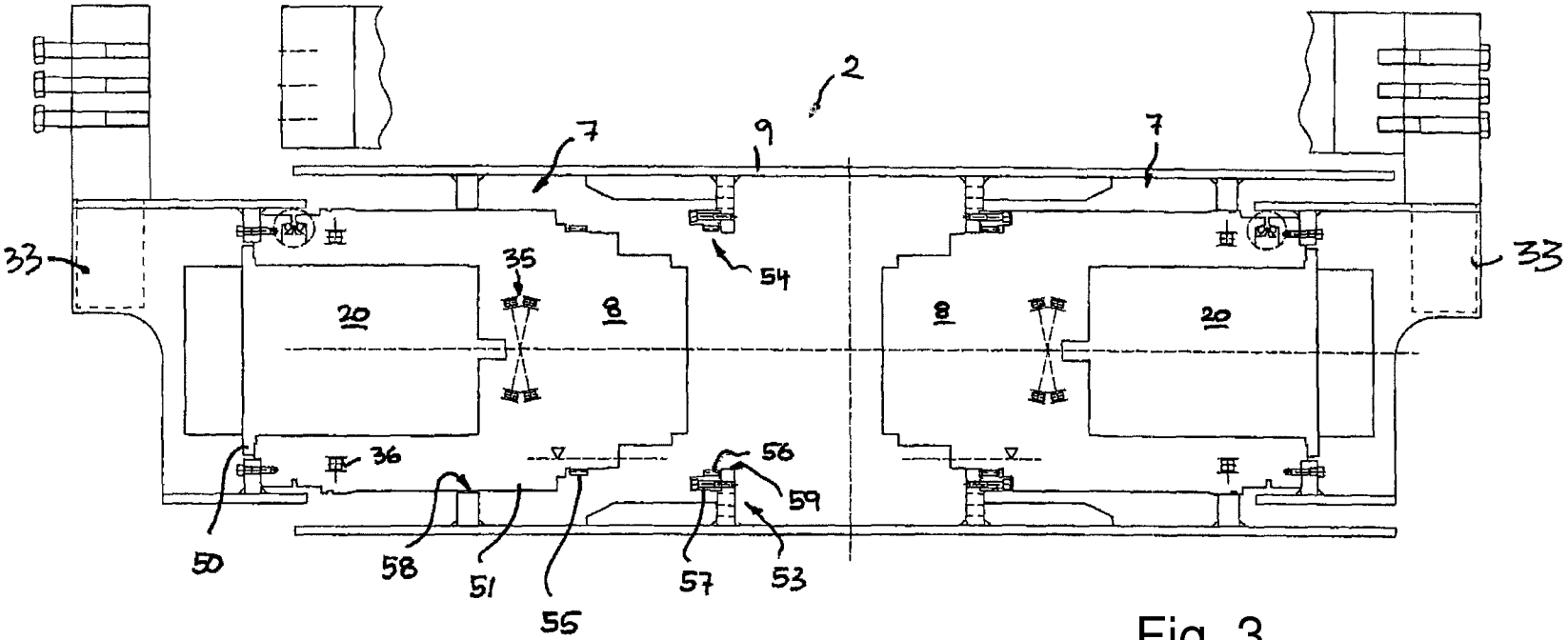
FIG. 3 shows a schematic longitudinal section through the milling drum of the surface milling cutter similar to FIG. 2, wherein one of the drum drive units arranged in the interior of the drum body is shown in a released position partly withdrawn from the drum body.

As shown in FIGS. 2 and 3, said anti-friction bearing arrangement in the depicted configuration comprises the aforementioned fixed bearing 35 in the region of the transmission inlet, which advantageously can be formed in the form of a double taper roller bearing in X-arrangement. Said fixed bearing 35 takes up radial forces and axial forces.

The exact angular alignment of the two housing parts 34 and 40 however is defined by the second bearing point, which is arranged with a large supporting distance from said fixed bearing 35 and is formed by said radial bearing 36. Advantageously, said radial bearing 36 can be arranged above the circumference of the electric motor 20 optionally in the half of the electric motor spaced from the transmission 8, optionally as close as possible to the frame strut or the aforementioned mounting flange 41. Said radial bearing 36, like the fixed bearing 35, is arranged between the aforementioned transmission bell and the outer transmission housing part 34.

As shown in FIG. 2, a sealing device 42 is provided between the two housing parts 34 and 40 rotatable relative to each other, wherein said sealing device 42 advantageously can be arranged as close as possible to said radial bearing 36 above the circumference of the electric motor 20. Said sealing device 42 for example can include simple radial shaft sealing rings. For a safe, leakage-free sealing even with a large accumulation of dirt, said sealing device 42 advantageously can comprise sliding ring seals which are fitted in between the two housing parts 34 and 40 rotatable relative to each other.

As an alternative to the described configuration, said anti-friction bearing arrangement can, however, also consist of two spaced taper roller bearings or corresponding angular-contact ball bearings, which advantageously are set in an O-arrangement, so that the effective supporting distance is broadened and correspondingly an increased flexural rigidity is achieved. Said taper roller bearings can be arranged in the region of the transmission inlet of the transmission 8, and in turn between the outer transmission housing 34 and the transmission bell 40 seated thereunder.

As shown in FIGS. 2 and 3, at least two drive units 7 advantageously can be provided in the interior of the drum body 9, wherein in particular to the right and left at the ends of the drum body 9 one drive unit 7 each can be provided, which advantageously is placed such that it does not protrude from the end face of the drum body 9. In principle, however, it would likewise be possible to arrange only one drive unit 7 in the interior of the milling drum, wherein here as well the drive unit advantageously can be arranged towards one side, while on the opposite side a support bearing without drive can be provided.

As shown in FIGS. 2 and 3, the stationary drive part 50 of the drive unit 7 for example is rigidly connected with the supporting frame part 33 extending around the end face of the drum body 9 via a screw connection 52.

On the roller body 9, however, the rotatable drive part 51 of the drum drive unit 7 is attached, namely in a torque-transmitting, but axially movable manner. For this purpose, an entrainment connection 53 is provided between the drum body 9 and the rotatable drive part 51, which is positively formed such that the rotatable drive part 51 is non-rotatably coupled with the drum body 9, but can slide in an axial direction, i.e. parallel to the axis of rotation of the drum body 9 relative to the drum body 9.

As shown in FIG. 3, advantageously, the entrainment connection 53 can comprise a toothing 54, for example in the form of a spline with involute flanks, which can include a first tooth part 55 provided on the rotatable drive part 51 and a second tooth part 56 provided on the drum body 9, which are in meshing engagement with each other. For example said first tooth part 55 can constitute an external toothing annularly extending around the outer circumference of the transmission housing, which can be pushed into an internally toothed ring, which forms the second tooth part 56. The toothing parts can directly be molded to the respective component or be cut onto the same. Advantageously, the tooth parts 55 and 56 can however also be formed separately and be firmly connected with the respective component. As shown in FIG. 3, for example the second tooth part 56 can be attached to a carrier flange, which protrudes from the drum body 9 to the inside, by means of a screw connection 57.

To couple the rotatable drive part 51 with the drum body 9 not only in a non-rotatable or torque-transmitting manner, but also radially and non-tiltably support the same on the drum body 9, said entrainment connection 53 furthermore can include radially effective support bearings 58, 59, for example in the form of centering fitting surfaces. Advantageously, said radially effective support bearings 58 and 59 can comprise carrier portions protruding from the inner circumferential surface of the drum body 9 to the inside, for example in the form of radial webs or flanges, which comprise a centering bore extending coaxially to the drum body axis of rotation. On said support bearings 58 and 59, the rotatable drive part 51 is accurately seated with corresponding supporting surfaces.

Advantageously, said support bearings 58 and 59 are axially spaced far from each other, wherein the axial spacing advantageously can amount to more than 50% of the axial length of the rotatable drive part 51. Due to such a large supporting width, tilting movements of the drum drive unit with respect to the drum body 9 can safely be compensated, without large surface pressures occurring at the support bearings 58 and 59. As shown in FIG. 2, at least one of the support bearings 58 advantageously can be located in direct vicinity, in particular directly above one of the anti-friction bearings, which rotatably supports the rotatable drive part 51 with respect to the fixed drive part 50. In this way an immediate, direct flux of force is achieved.

In an advantageous development of the present disclosure, one of the radially effective support bearings 59 can be provided in direct vicinity of the aforementioned toothing 54, in order to avoid radial overloads of said toothing 54.

To prevent fretting rust at the points of connection between the drum body 9 and the rotating drive housing part 34, the drum body 9 is filled with oil or another suitable lubricant in its interior, so that the connecting points at the support bearings 58, 59 and/or the entrainment connection 53 are running in an oil bath. As shown in FIG. 2, the level 91 of the lubricant bath is dimensioned such that at least the lower part of the drive housing part 34 including said connecting points of the support bearings 58, 59 or the entrainment connection 53, when the same are at least partly just located in the lower circulating segment, is running or wetted in the oil bath.

To achieve a circulation of the oil and an entrainment of the oil to the top, drag shovels or web plates or similar circulating elements 100 can be provided in the interior of the drum body 9, which circulate with the drum body 9. For example, said circulating elements 100 can circumferentially be attached to the drum body 9 on the inside.

To ensure the oil distribution in the case of several connecting points, for example said toothing 54 or said support bearings 58, 59, to all connecting points, oil passages or oil channels 120 can be provided at a suitable point. For example, a connecting point located towards the drum center, in particular the supporting flange 59, can be provided with an oil channel 120 for oil distribution, cf. FIG. 2.

Towards the outside, the interior space of the drum body is sealed. A sealing device 110 for example in the form of an O-ring can be integrated into the connecting point 58, cf. FIG. 2.

The invention claimed is:

1. A self-propelled surface milling cutter, with a working assembly comprising a rotatingly drivable drum body, and at least one drum drive unit which is accommodated in an interior of the drum body and forms at least part of a rotatable bearing of the drum body on a drum supporting frame, wherein the at least one drum drive unit includes a stationary drive part attached to the drum supporting frame and a rotatable drive part connected with the drum body, wherein the rotatable drive part is mounted on the drum body in a torque-transmitting, but longitudinally movable manner by a positive entrainment connection, the entrainment connection including a toothing having a first tooth part on the rotatable drive part and a second tooth part on an inner circumferential surface of the drum body, and wherein a lubricant bath in the interior of the drum body has a level which wets the toothing.

2. The self-propelled surface milling cutter according to claim 1, wherein the toothing is formed as a spline with involute flanks.

3. The self-propelled surface milling cutter according to claim 1, wherein the entrainment connection is formed to be radially supporting such that, due to the entrainment connection, the drum body is supported on the drum drive unit without clearance, transverse to its axis of rotation.

4. The self-propelled surface milling cutter according to claim 3, wherein the entrainment connection comprises axially spaced, radially effective support bearings, including centering fitting surfaces coaxial to the axis of rotation of the drum body, by which the drum body is radially supported on the rotatable drive part.

5. The self-propelled surface milling cutter according to claim 4, wherein the entrainment connection is formed without undercut in an axial direction towards a drum body end face such that the drum drive unit as a whole can axially be withdrawn from the drum body, wherein the support bearings of the entrainment connection increase in diameter towards the drum body end face.

6. The self-propelled surface milling cutter according to claim 1, wherein radially effective support bearings for transversely supporting the drum body on the rotatable drive part are directly arranged on the toothing of the entrainment connection.

7. The self-propelled surface milling cutter according to claim 1, wherein the lubricant bath is positioned for lubricating the entrainment connection and/or for protection of the entrainment connection against fretting rust.

8. The self-propelled surface milling cutter according to claim 7, wherein the level of the lubricant bath further wets at least a part of the rotatable drive part.

9. The self-propelled surface milling cutter according to claim 7, wherein in the interior of the drum body at least one circulating element is positioned for circulating lubricant upon rotation of the drum body and/or rotation of the rotatable drive part.

10. The self-propelled surface milling cutter according to claim 1, wherein the interior of the drum body is sealed against the rotatable drive part by a sealing device in a lubricant-tight manner, wherein the sealing device is integrated into a supporting point arranged closest to a drum body end face, which radially supports the drum body on the rotatable drive part.

11. The self-propelled surface milling cutter according to claim 10, wherein the sealing device includes at least one sliding ring seal.

12. The self-propelled surface milling cutter according to claim 1, wherein at least one portion of the entrainment connection is bypassed with a compensating and/or overflow channel, through which lubricant is guided past said portion of the entrainment connection to various portions of the entrainment connection.

13. The self-propelled surface milling cutter according to claim 1, wherein the rotatable bearing of the drum body on the drum supporting frame comprises at least one anti-friction bearing arrangement, which is integrated into the drum drive unit and as such forms a statically determinate or overdeterminate radial and axial bearing such that the rotatable drive part relative to the stationary drive part of the drum drive unit are axially, radially and angularly firmly mounted to each other.

14. The self-propelled surface milling cutter according to claim 13, wherein a plurality of drum drive units with integrated anti-friction bearing arrangement each as such statically determinate or overdeterminate are provided.

15. The self-propelled surface milling cutter according to claim 13, wherein between the stationary drive part and the rotatable drive part a sealing device is provided for a dust-tight and/or fluid-tight sealing of the drum drive unit.

16. The self-propelled surface milling cutter according to claim 15, wherein the anti-friction bearing arrangement integrated into the drum drive unit includes at least one bearing point directly below or directly beside the sealing device as well as a bearing point spaced from the sealing device.

17. The self-propelled surface milling cutter according to claim 15, wherein the drum drive unit comprises at least one electric motor as well as a transmission connected with the electric motor, wherein the anti-friction bearing arrangement integrated into the drum drive unit includes a bearing point in a region of the transmission, in a region of a transmission inlet of the transmission between said stationary and rotatable drive parts, as well as a bearing point in a region of the circumference of the electric motor, including in a half of the electric motor facing away from the transmission.

18. The self-propelled surface milling cutter according to claim 17, wherein the anti-friction bearing arrangement comprises two bearing points spaced from each other in the region of the transmission inlet of the transmission.

19. The self-propelled surface milling cutter according to claim 17, wherein for sealing the transmission and/or the rotatable bearing, the sealing device includes a seal in the region above the outer circumference of the electric motor.

20. The self-propelled surface milling cutter according to claim 17, wherein the sealing device comprises a seal in the region between the electric motor and the transmission.

21. The self-propelled surface milling cutter according to claim 13, wherein the anti-friction bearing arrangement of at least one drum drive unit comprises an axially fixed bearing, in the form of a double taper roller bearing in an X-arrangement, and a radial bearing spaced therefrom.

22. The self-propelled surface milling cutter according to claim 13, wherein the anti-friction bearing arrangement of at least one drum drive unit includes two mutually spaced taper roller bearings or angular-contact ball bearings in an O-arrangement.

23. The self-propelled surface milling cutter according to claim 1, wherein the rotatable drive part forms an outer transmission housing part.

24. The self-propelled surface milling cutter according to claim 23, wherein the first tooth part comprises an external toothing annularly extending around an outer circumference of the outer transmission housing part, which can be pushed into an internally toothed ring which forms the second tooth part.

* * * * *

UNITED STATES PATENT AND TRADEMARK OFFICE

CERTIFICATE OF CORRECTION

PATENT NO. : 8,876,219 B2
APPLICATION NO. : 13/552471
DATED : November 4, 2014
INVENTOR(S) : Norbert Hausladen and Viktor Schindler It is certified that error appears in the above-identified patent and that said Letters Patent is hereby corrected as shown below:

On the Title Page, in item (73) in the assignee section, please delete "Werk" between "Liebherr-" and "Biberach" and replace with --Components--.

Signed and Sealed this
Twenty-third Day of June, 2015

Michelle K. Lee

Michelle K. Lee
*Director of the United States Patent and Trademark Office*